United States Patent [19]

Eisenberg et al.

[11] Patent Number: 4,705,215

[45] Date of Patent: Nov. 10, 1987

[54] ARRANGEMENT FOR SECURING RAILWAY RAILS ONTO SLEEPERS

[75] Inventors: Helmut Eisenberg, Werdohl; Henning von Heimburg, Lüdenscheid; Friedhelm Weber, Neuenrade; Achim Beste; Dirk Vorderbrück, both of Werdohl, all of Fed. Rep. of Germany

[73] Assignee: Vossloh-Werke GmbH, Werdohl, Fed. Rep. of Germany

[21] Appl. No.: 853,021

[22] Filed: Apr. 17, 1986

[51] Int. Cl.[4] ..... E01B 9/00; E01B 21/04

[52] U.S. Cl. ..... 238/349; 238/338

[58] Field of Search ..... 238/309, 310, 338, 349

[56] References Cited

U.S. PATENT DOCUMENTS

| | | | |
|---|---|---|---|
| 816,452 | 3/1906 | Freeman et al. | 238/309 |
| 2,158,057 | 5/1939 | Febrey | 238/349 |
| 2,203,624 | 6/1940 | Clarkson | 238/349 |
| 2,291,743 | 8/1942 | Muller | 238/349 |
| 2,905,390 | 9/1959 | Saul | 238/309 |
| 3,439,874 | 4/1969 | Meier | 238/349 |
| 3,640,460 | 2/1972 | Baesler | 238/349 |
| 3,690,551 | 9/1972 | Munch | 238/349 |
| 3,799,437 | 3/1974 | Scherbaum | 238/349 |
| 3,876,141 | 4/1975 | French | 238/349 |

FOREIGN PATENT DOCUMENTS 1261151 8/1968 Fed. Rep. of Germany .

*Primary Examiner*—Robert B. Reeves
*Assistant Examiner*—Charles Barrett
*Attorney, Agent, or Firm*—James J. Ralabate

[57] ABSTRACT

The invention relates to a rail securing arrangement, which has the following features. It comprises metal plates, each of which lies with its flat lower surface on the sleeper, and on whose upper surface two ribs are formed which extend in the longitudinal direction of the rail, and between which the foot of the sleeper lies on a bearing surface. On both sides of the rail in the region of the respective ribs, each plate has moreover at least one through-hole, with which a respective through-hole in the sleeper is aligned. Corresponding screws are each introduced with their lower ends into the respective through-holes of the plate and engage with a hook-like bend beneath the lower surface of the plate. Each screw is provided at its upper end with a thread onto which a respective nut is screwed. Furthermore, the securing arrangement comprises plate-like securing elements which are each bent to form a double-armed angle member. The first arm of each securing element engages, together with the associated screw in the corresponding through-hole in the plate, whereby the screw is fixed in this through-hole in such manner that the hook-like bend of the screw engages securely beneath the lower surface of the plate. The second arm of each securing element extends perpendicularly away from the rail and lies at least partially on the upper surface of the plate. Finally, clips are provided, which each have a respective screw. Each clip consists of a round-sectioned steel rod and possesses a form which is symmetrical to a vertical plane perpendicular to the rail. Each clip surrounds the associated screw with a central part which lies beneath the nut. A part of the clip facing the rail lies on the rail foot, while an outer part of the clip facing away from the rail presses from above on the upper surface of the plate.

4 Claims, 4 Drawing Figures

ARRANGEMENT FOR SECURING RAILWAY RAILS ONTO SLEEPERS

The invention relates to an arrangement for securing railway rails onto sleepers, in particular wooden sleepers.

FIGS. 1 and 2 illustrate a known securing arrangement of this type which is designed principally for use with wooden sleepers 1. It comprises a steel plate 2 which lies with its flat lower surface 2*a* on the upper surface 1*a* of the sleeper. On the upper surface 2*b* of the plate 2 are provided two mutually parallel and spaced ribs 2*c*. A bearing surface 2*d* is defined therebetween. The foot 3*a* of a rail 3, which is only partially illustrated, lies between these ribs 2*c* on the bearing surface 2*d*.

For securing the plate 2 on the sleeper 1, the plate is provided with a number, for example two, of through-holes 2*e* on each side of the rail 3, which holes are each arranged at the same distance from the rail 3. These through-holes 2*e* are aligned with through-holes 1*b* in the sleeper 1. Nails 4 are driven into respective pairs of holes 2*e*, 1*b* which lie on opposite sides of the rail 3 and are mutually staggered with relation to the longitudinal direction of the rail 3.

For securing the rail 3 to the plate 2, the plate 2 possesses in the region of each of the ribs 2*c*, but outside the bearing surface 2*d*, a number, for example two, of through-holes 2*f*, which are aligned with through-holes 1*c* in the sleeper 1. Nails 4 are also driven into two pairs of holes 2*f*, 1*c*, which are positioned on opposite sides of the rail 3 and are mutually staggered with respect to the longitudinal direction of the rail 3. These nails press with their broadened heads on the foot 3*a* of the rail 3 and thus press the rail 3 onto the plate 2.

U.S. Pat. No. 4,350,291 relates to an assembly with which the above described rail fastening can be reconstructed or renovated. For this purpose the nails 4, by which the rail 3 is pressed onto the plate 2, are pulled out directly on the track. Then, instead of these nails special clips are employed for securing the rail on the plate. Each clip consists of round-section steel which is bent into five sections. The first section is substantially straight. The second section has a reversed bend of small diameter. The third section is straight and extends substantially parallel to the first section. The fourth section has another reversed bend, but of larger diameter than the firt bend. Then the fifth section is again substantially straight and extends parallel to the first and third sections, but at a certain distance therefrom. For securing this clip appropriate preparatory steps must be taken with the sleeper and plate. A bore-hole must be provided for each clip in the sleeper, the hole being outside of the bearing surface of the rail on the rib and extending parallel to the longitudinal direction of the rail. On the upper side of the rib a groove must be cut in the sleeper largely above the bore-hole. This groove is expediently lined with a channel-like plate, which must be welded to the plate. Only then can the mounting of the clip take place. For this purpose, the first end of the clip is inserted into the bore-hole of the sleeper and then comes to lie below the plate. The third section of the clip comes to lie in the groove on the upper side of the plate or in the plate-shaped channel of this groove. The fifth section comes to lie on the foot of the rail and thus presses the rail against the bearing surface of the plate between the two ribs.

This described arrangement has first and foremost the disadvantage that both on the rail and also on the sleeper relatively complicated preparatory steps must be carried out to enable mounting of the clip.

Having regard to the above it is an object of the invention to provide a rail securing arrangement which not only can be used to renovate the rail fastening described above, but also can achieve this in a considerably simpler manner using a clip, which has already proved extremely satisfactory over a long service life in other rail securing arrangements.

This object is achieved by a rail securing arrangement which possesses the following features. It comprises metal plates, each of which lies with its flat lower surface on the sleeper and on the upper surface of which are provided two ribs extending in the longitudinal direction of the rail between which the foot of the sleeper lies on a bearing surface. Each plate has moreover on each side of the rail in the region of the respective rib at least one through-hole aligned with a corresponding through-hole in the sleeper. Suitable screws are inserted with their respective lower ends in the respective through-holes of the plate, and engage by means of a hook-like bend beneath the lower side of the plate. Each screw is provided at its upper end with a respective thread, onto which a respective nut is screwed. Furthermore, the fastening arrangement comprises plate-like securing elements which are each bent to form a double-armed angle member. The first arm of each securing element engages together with the associated screw in the corresponding through-hole in the plate, whereby the screw is fixed in this through-hole in such manner that the hook-like bend grips the screw securely beneath the lower side of the plate. The second arm of the respective securing element extends perpendicularly away from the rail and lies at least partially on the upper side of the plate. Finally, clips are provided, which are each associated with a respective screw. Each clip consists of a round section steel rod and possesses a form which is symmetrical to a vertical plane perpendicular to the rail. Each clip holds the associated screw with a central part which lies beneath the nut. A part of the clip towards the rail lies on the rail foot, whilst a part of the clip facing away from the rail presses from above on the upper side of the plate.

By means of the securing arrangement according to the invention, the known securing arrangements can be reconditioned, and what is more without the need to renovate the sleepers and plates, which are reused. On the contrary, these components can remain unchanged in the track bed. Also the through-holes present in the plates and the rails need not be changed. In this connection, clips can be used which have already been employed in combination with many securing arrangements for years and have proved extremely satisfactory over this extensive service life. These clips are the subject matter, for example, of German Pat. No. 1,261,151.

The securing elements specially developed for the fastening arrangement according to the invention are simple to manufacture and practical to install. In the installation, the screws need only be inserted with their hook-like bends in the respective corresponding through-holes of the plate, until the hook-like bends come to lie beneath the lower side of the plate. Thereafter, the corresponding arms of the respective securing elements are driven into the relevant through-holes. During this process, the hook-like bend of each screw is pressed somewhat into the wood of the sleeper until the hook-like bend grips securely beneath the lower side of the plate. Thus the screw is reliably fixed in its installed position.

Thereafter the clips according to the invention can be placed on the screws and the nuts tightened so that the clips are pressed on the foot of the rail, and thus securely fix the rail onto the plates and thus onto the sleepers.

The preferred construction of the clip employed is such that the respective clip has substantially a W-shape and in the installed position surrounds the shaft of the screw with an arcuate central part, whilst the bends ajoining the central part press on the plate and the free ends directed towards one another and ajoining the bends press on the foot of the rail. The second arm of the securing element lies between the bends of the clip; thus the clip is prevented from twisting during tightening.

It can also prove expedient if a washer is arranged between the nut and the central part of the clip.

Of course, the plate is secured on the sleeper by means of a securing arrangement of suitable type. In this connection, the fastening arrangement can be used with nails of known type. A specially developed fastening arrangement can however also be employed.

DESCRIPTION OF THE DRAWING AND OF THE PREFERRED EMBODIMENT

An exemplary embodiment of the securing arrangement according to the invention will be explained in more detail in the following with reference to FIGS. 3 and 4, which illustrate a securing arrangement on one side of the rail, FIG. 3 being a vertical section perpendicular to the rail and FIG. 4 being a plan view.

Figure 1:
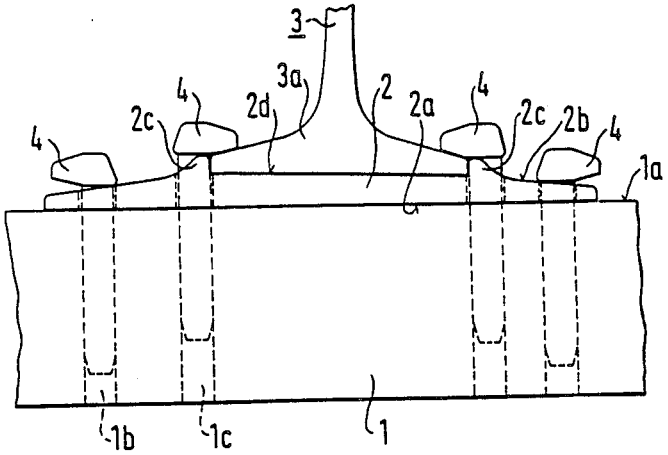
FIG. 1 PRIOR ART
FIG. 1 is a side sectional view of the prior art rail fastening means.
Figure 2:
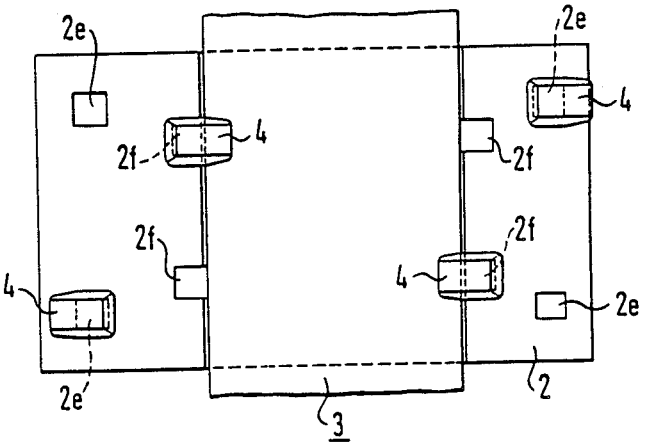
FIG. 2 PRIOR ART
FIG. 2 is a top plan view of the prior art rail fastening means.
Figure 3:
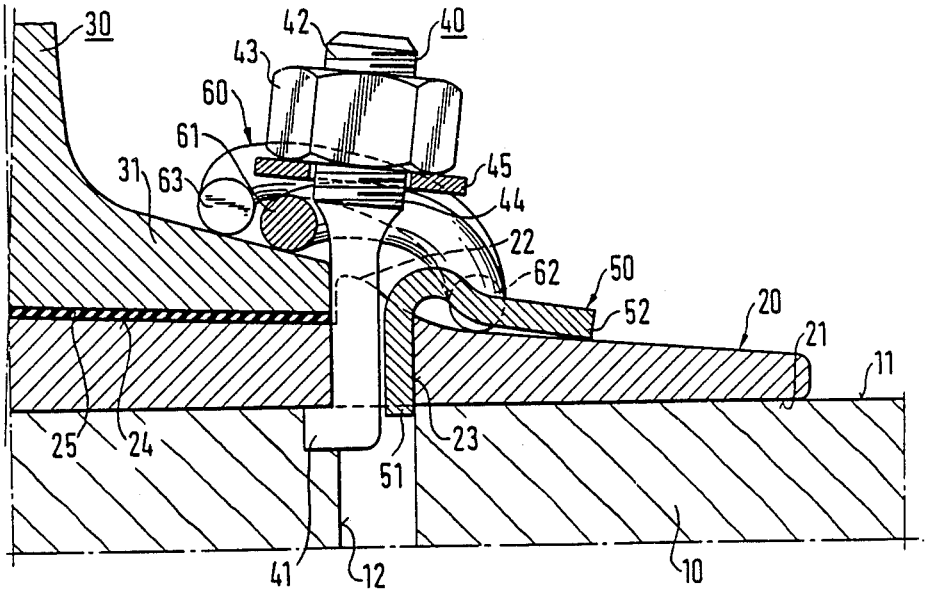
FIG. 3 is a vertical sectional view of the securing or fastening means of the present invention.
Figure 4:
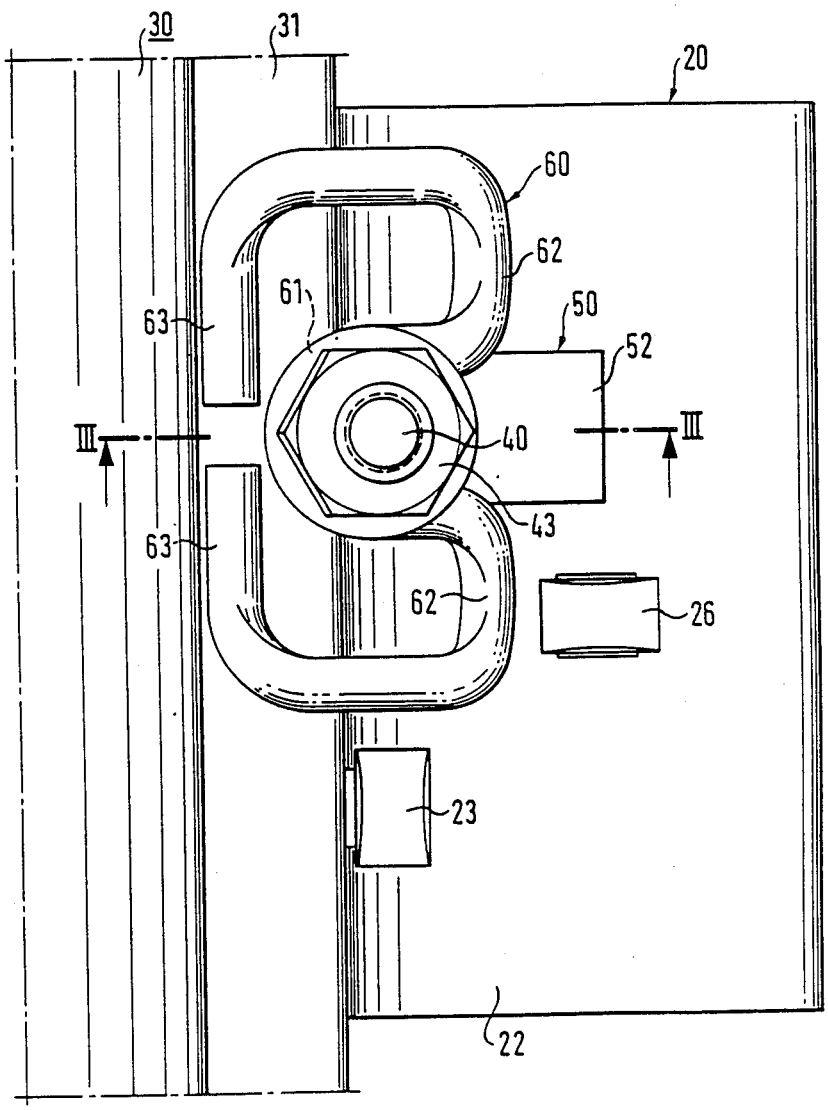
FIG. 4 is a top plan view of the fastening or securing means of the present invention.

According to FIGS. 3 and 4, the wooden sleeper is designated with 10, whilst the plate and the rail carry the reference signs 20 and 30. As already explained, the plate 20 lies with its flat lower surface 21 on the upper surface of the sleeper. On its upper surface the plate has two ribs 22 which are mutually parallel and extend in the longitudinal direction of the rail 30 at a mutual spacing. In this manner, a flat bearing surface 24 on which the foot 31 of the rail 30 lies, is created between the ribs 22.

In the region of each rib 22, the plate has at least one through-hole 23. Each through-hole 23 in the plate 20 is aligned with a through-hole 12 in the sleeper 10.

The rail fastening moreover comprises screws which are together designated with 40. Each screw 40 is introduced at its lower end into the associated through-hole 23 of the plate. This lower end of the screw 40 has a hook-like bend 41. This hook-like bend engages, as best seen in FIG. 3, beneath the lower surface 21 of the plate 20 and is thus locked in the vertical direction. On its upper end, each screw 40 has a thread 42, onto which a nut 43 is screwed. In its central part, each screw 40 may have a collar 44.

For securing the screws 40 in the relevant through-holes 23 of the plate 20, plate-like securing elements are provided, which are together designated with 50. Each plate-like securing element 50 is bent to form a double-armed angle member. In the installed condition, the first arm 51 of the securing element 50 likewise engages in the corresponding through-hole 23 of the plate 20. This arm 51 thus presses the screw 40 in such direction that the hook-like bend 41 of the screw 40 engages securely and fixedly beneath the lower surface 21 of the plate 20. The second arm 52 of the securing element 50 extends perpendicularly away from the rail 30 and lies, at least with its free end, on the upper surface of the plate 20.

Finally, the securing arrangement according to the invention comprises elastic clips, which are together designated with 60. Each clip consists of a round-section steel rod and comprises a form in the shape of a W, which is symmetrical with respect to a vertical plane III—III perpendicular to the rail. A central part 61 of the clip 60 is formed by a bend of 180 degrees. This central part 61 partially surrounds the shaft of the screw 40 and comes to lie beneath the nut 43. A part facing away from the rail is formed by arcs 62 ajoining the central part. Each part 62 presses on the upper surface of the plate 20. The second arm 52 of the securing element 50 comes to lie between the arcs 62 of the clip 60; thus this clip is prevented from twisting, particularly during tightening. A part of the clip 60 facing the rail is formed by free ends 63 of the round steel rod directed towards one another. Each part 63 is pressed on the foot 31 of the rail. Furthermore, also the central part 61 can press on this foot. The clip 60 is subjected to corresponding tensioning by tightening the nut 43.

Between the nut 43 and the central part 61 of the clip 60, a washer 45 can be arranged. Finally, an intermediate layer 25 of rubber or synthetic material can be inserted between the foot 31 of the rail 30 and the bearing surface 24 of the plate 20.

Naturally, a suitable securing arrangement is provided for securing the plate 20 on the sleeper 10. Since this forms no part of the invention, this is omitted. Only in FIG. 4 is it possible to see a through-hole 26 in the plate 20 for this purpose.

What is claimed is:

1. Arrangement for securing railway rails to sleepers, in particular wooden sleepers, comprising metal plates, each of which lies with its flat lower surface on a sleeper, on the upper surface of which plates are provided two ribs extending in the longitudinal direction of the rail, between which ribs the foot of the sleeper lies on a bearing surface, and which plates have on both sides of the rail in the region of each rib at least one through-hole, with which a respective through-hole in the sleeper is aligned;

screws, each having a diameter which is smaller than the diameter of the through-hole of the plate, each being inserted with its lower end into the respective through-hole of the plate and engaging with a hook-like portion beneath the lower surface of the plate, and each being provided on its upper end with a thread, with which a nut is engaged;

plate-like securing elements, each forming a double-armed angle member, each first arm, together with the associated screw, engaging in the corresponding through-hole in the plate and thus fixing the screw in this through-hole in such manner that the hook-like portion of the screw engages securely beneath the lower surface of the plate, and each second arm extending perpendicularly away from the rail, and lying at least partially on the upper surface of the plate;

resilient clips, which are each associated with a respective screw, and each of which consists of a round-section steel rod, and has a form which is symmetrical to a vertical plane perpendicular to the rail, a central part partially surrounding the screw and lying beneath the nut, a part facing the rail lying on the rail foot, and a part facing away from the rail, pressing from above on the upper surface of the plate and said resilient clips having bends adjoining said central part adapted to press on said plate and whereby said second arm of said plate-like securing elements lies between said bends of the clips and is adapted to prevent the clip from twisting during tightening.

2. Arrangement according to claim 1 wherein the clip is substantially W-shaped and in the installed condition surrounds with said central part the shaft of the screw, whilst bends ajoining the central part press on the plate and on the second arm of the securing element, and free ends ajoining the bends and directed towards one another press on the foot of the rail.

3. Arrangement according to claim 1 wherein a washer is arranged between the nut and the central part of the clip.

4. Arrangement according to claim 1 wherein the plate is secured to the sleeper by means of a securing arrangement.

* * * * *